US009364062B2

(12) United States Patent
Stukenkemper

(10) Patent No.: US 9,364,062 B2
(45) Date of Patent: Jun. 14, 2016

(54) CASE

(75) Inventor: Heinrich Stukenkemper, Castrop-Rauxel (DE)

(73) Assignee: Faber-Castell AG, Stein (DE)

( * ) Notice: Subject to any disclaimer, the term of this patent is extended or adjusted under 35 U.S.C. 154(b) by 1723 days.

(21) Appl. No.: 12/131,596

(22) Filed: Jun. 2, 2008

(65) Prior Publication Data

US 2008/0296179 A1 Dec. 4, 2008

(30) Foreign Application Priority Data

May 31, 2007 (DE) ..... 10 2007 025 548

(51) Int. Cl.
*A45C 11/34* (2006.01)
*A45C 13/02* (2006.01)

(52) U.S. Cl.
CPC ..... *A45C 11/34* (2013.01); *A45C 13/02* (2013.01); *A45C 2013/026* (2013.01)

(58) Field of Classification Search
CPC ... A45C 11/34; A45C 13/02; A45C 2013/026
USPC ..... 206/581, 747, 748, 214; 220/747, 526
See application file for complete search history.

(56) References Cited

U.S. PATENT DOCUMENTS

| | | | | | |
|---|---|---|---|---|---|
| 4,421,127 | A | * | 12/1983 | Geer | 132/294 |
| 6,109,442 | A | * | 8/2000 | Roegner | 206/581 |
| 6,164,451 | A | * | 12/2000 | Sherman | 206/581 |
| 6,164,859 | A | * | 12/2000 | Hambright | 402/73 |
| D482,162 | S | * | 11/2003 | Bostroem | D28/77 |

FOREIGN PATENT DOCUMENTS

| | | |
|---|---|---|
| DE | 1885831 U | 1/1964 |
| DE | 1934514 U | 3/1966 |
| DE | 3246098 A1 | 6/1984 |

* cited by examiner

*Primary Examiner* — Jacob K Ackun
*Assistant Examiner* — Rafael Ortiz
(74) *Attorney, Agent, or Firm* — Laurence A. Greenberg; Werner H. Stemer; Ralph E. Locher

(57) ABSTRACT

A case has a body formed of a lower shell and an upper shell pivotally connected to each other. The lower shell contains a plurality of compartments serving to receive objects. A plate, one side of which bears holding elements for writing implements, is mounted on the body in a manner such that it can pivot about a pivot axis running approximately parallel to the flat plane of the lower shell. The plate, in a first pivoted position, rests on the lower shell and covers at least some of the compartments thereof and, in a second pivoted position, is swung out of the lower shell.

7 Claims, 4 Drawing Sheets

CASE

CROSS-REFERENCE TO RELATED APPLICATION

This application claims the priority, under 35 U.S.C. §119, of German application DE 10 2007 025 548.0, filed May 31, 2007; the prior application is herewith incorporated by reference in its entirety.

BACKGROUND OF THE INVENTION

Field of the Invention

The invention relates to a case for storing and for transporting objects, in particular writing implements, such as pencils, fountain pens and ball point pens, but also for implements, such as erasers, pencil sharpeners, scissors, stickers and the like.

A case which has compartments for receiving objects is revealed, for example, in German utilty model DE 1 885 831 U (Gebrauchsmuster). Writing implements can be accommodated in the interior of the case either in compartments or with the aid of loops. German utility model DE 1 934 514 U (Gebrauchsmuster) shows a case in which the writing implements are held with the aid of loops, and which is additionally provided with two foldable plates. The latter are attached to mutually opposite borders of the upper and/or lower part of the case. The two plates can each be folded onto the inner side of the upper and/or lower part, and are themselves set up to receive writing utensils. German published patent application DE 32 46 098 A1 (Offenlegungsschrift) discloses a pupil's pencil case which has an intermediate plate between its bottom plate and its cover plate. The bottom plate and cover plate are fastened to opposite sides of the intermediate plate, and, on both sides together with the latter, form sections which are separated from one another.

SUMMARY OF THE INVENTION

It is accordingly an object of the invention to provide a case, which overcomes the above-mentioned disadvantages of the heretofore-known devices and methods of this general type and which is particularly suited to securely accommodate writing utensils for transportation and such that they cannot damage one another and make one another dirty.

With the foregoing and other objects in view there is provided, in accordance with the invention, a case, comprising:

a body formed of a lower shell and an upper shell pivotally connected to the lower shell;

the lower shell having a plurality of compartments configured to receive objects;

a first plate pivotally mounted to the body about a pivot axis extending substantially parallel to a flat plane of the lower shell, the first plate, in a first pivot position, resting on the lower shell and covering at least some of the plurality of compartments and, in a second pivot position, being swung out of the lower shell;

the first plate having an inner side facing the compartments in the first pivot position, and holding elements for writing implements disposed on the inner side of the first plate; and a second plate pivotally connected to a border region of the first plate about a pivot axis running approximately parallel to the flat plane of the lower shell and foldable onto the inner side of the first plate;

the second plate, in the first pivot position of the first plate and upon being folded onto the inner side of the first plate, being disposed between the first plate and the compartments and covering at least some of the compartments.

In other words, the novel case has a body formed from two shells, namely a lower shell and an upper shell, which are connected pivotably to each other. By means of the pivotable connection, the shells can be opened wide and are therefore easily accessible in order to accommodate objects therein or to remove them therefrom. The lower shell contains a plurality of compartments which serve to accommodate diverse writing utensils, and additional utensils such as a pair of scissors, a pencil sharpener, a fountain pen, replacement ink cartridges, etc., in an orderly manner. The objects are separated from one another by means of the compartments, and therefore they cannot touch one another and be damaged during transportation. In order for it not to be possible for the objects to drop out of the compartments, it would be conceivable to close said compartments with a cover. According to the invention, a plate which is connected pivotably to the body and can be pivoted between a first and a second pivoted position is provided for this, said plate resting on the lower shell in the first position and covering at least some of the compartments and being swung out of the lower shell in the second pivoted position. In addition to its function of closing the compartments, the flap has a further function, serving namely as a support for writing implements, for example coloring pencils and lead pencils.

Owing to the fact that the holding elements are arranged on the inner side of the plate, which inner side faces the compartments in the first pivoted position, writing implements held by them are visible in the unfolded state or in the second pivoted position of the plate and can be removed, with the compartments being accessible at the same time. In order to protect the writing implements held on the inner side of the plate, a second or additional plate is provided. In the folded-in state of the first plate, the additional plate is arranged between the first plate and the compartments and at least partially covers the compartments.

According to one embodiment, holding elements for writing implements are also attached to the additional plate, to be precise on its side which faces the inner side of the first plate in the folded-in state. In this case, when the first plate is folded inward, i.e. is in its first pivoted position, the additional plate covers the compartments with its second side which does not bear any holding elements or writing implements. In this way, the writing implements are protected against being touched by objects stowed in the compartments.

The pivot axes of the first plate and of the second plate run essentially parallel to each other. In this case, the second or additional plate is connected to the side border which lies opposite that side border of the plate at which said plate is coupled to the body. In other words, the additional plate and the body are connected to the plate at mutually opposite side borders of said plate. This configuration makes it possible for the plate and the additional plate to be arranged in a row next to each other in the open state of the case. All of the writing implements supported by them, and the objects present in the compartments of the lower shell are in this way visible and accessible and can be removed.

A technically simple and cost-effective fixing of the plate to the body or to the lower shell thereof resides in the use of a flexible material strip. The same also applies to the connection between the plate and additional plate. The holding elements for writing implements are arranged in a row and are offset in the row direction in relation to the holding elements of the other plate in each case. Such an arrangement of the writing implements results in space saving in the vertical direction of the case. It is particularly advantageous if the offset corresponds approximately to half the diameter of the writing implements held. The upper shell is connected to the lower shell with the aid of a zipper. In a particularly preferred variant embodiment, the compartments in the lower shell are formed by an insert which has compartments and is arranged in the lower shell. Such an insert can be produced in a simple manner, for example as an injection-molded part, with it also increasing the dimensional stability of the lower shell. In addition, it can easily be cleaned, especially if it is fixed releasably in the lower shell.

Other features which are considered as characteristic for the invention are set forth in the appended claims.

Although the invention is illustrated and described herein as embodied in case, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
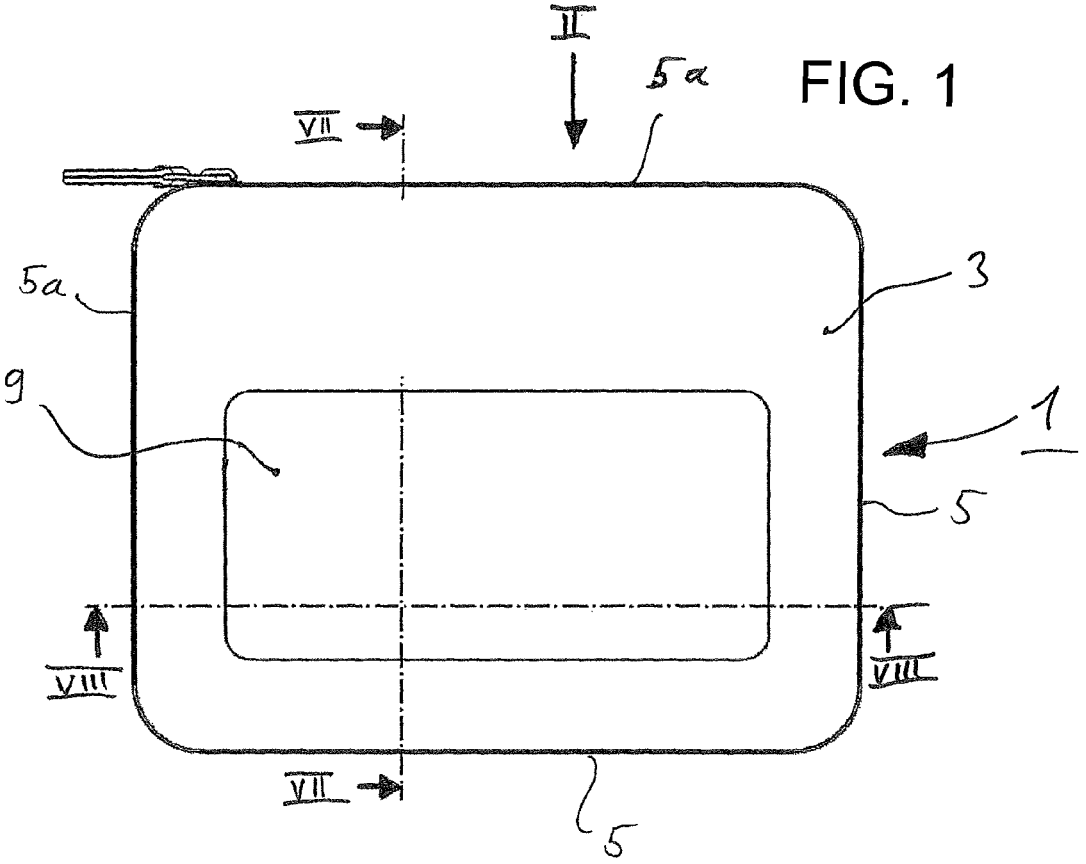
FIG. 1 is a top plan view of the upper side of a case according to the invention having a lower shell and an upper shell.
Figure 2:
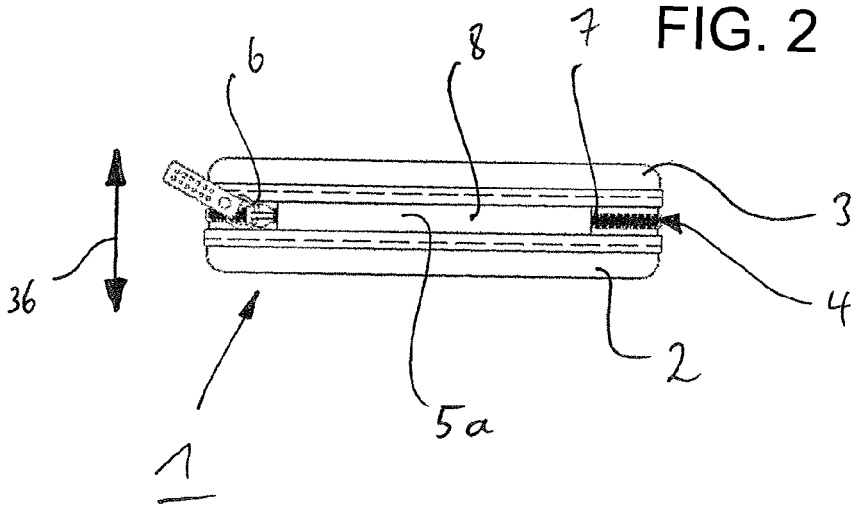
FIG. 2 is a side view taken in the direction of the arrow 11 in FIG. 1.

Referring now to the figures of the drawing in detail, the case 1 is substantially formed from two half shells, namely—with reference to its typical use—of a lower shell 2 and an upper shell 3 (cf. FIGS. 1 and 2). The shells are connected to each other via a zip fastener or zipper 4. The latter extends entirely over three of the total of four side surfaces 5 of the case 1. It extends into the remaining, fourth side surface 5, the rear side 5*a*, for just a section in each case on both sides, with a flexible material strip 8, for example a fabric tape, being arranged between the start 6 and the end 7 of the zip fastener 4 and ensuring a pivotable connection between the upper shell 3 and the lower shell 2. A viewing window 9 formed from transparent material is integrated in the upper shell 3 of the case 1. The window 9 in the exemplary embodiment has a substantially rectangular contour shape.

Figure 3:
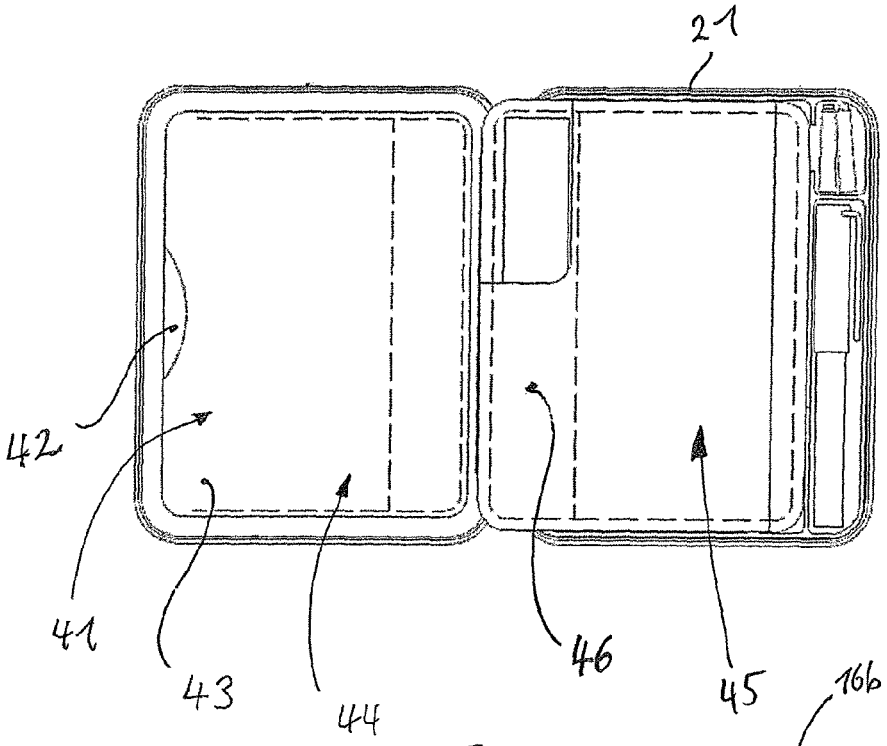
FIG. 3 is a top view of the opened case in a first use situation.
Figure 4:
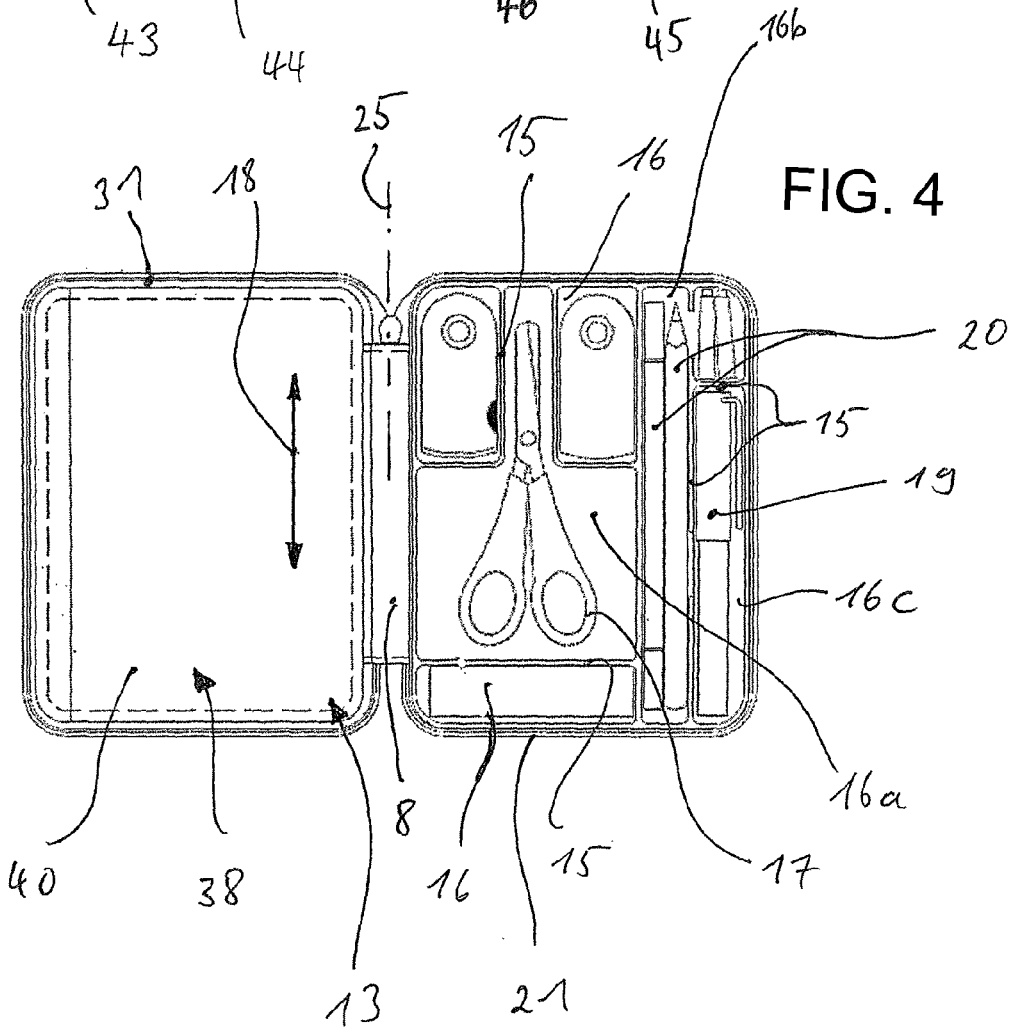
FIG. 4 is a top view of the case in a second use situation.
Figure 5:
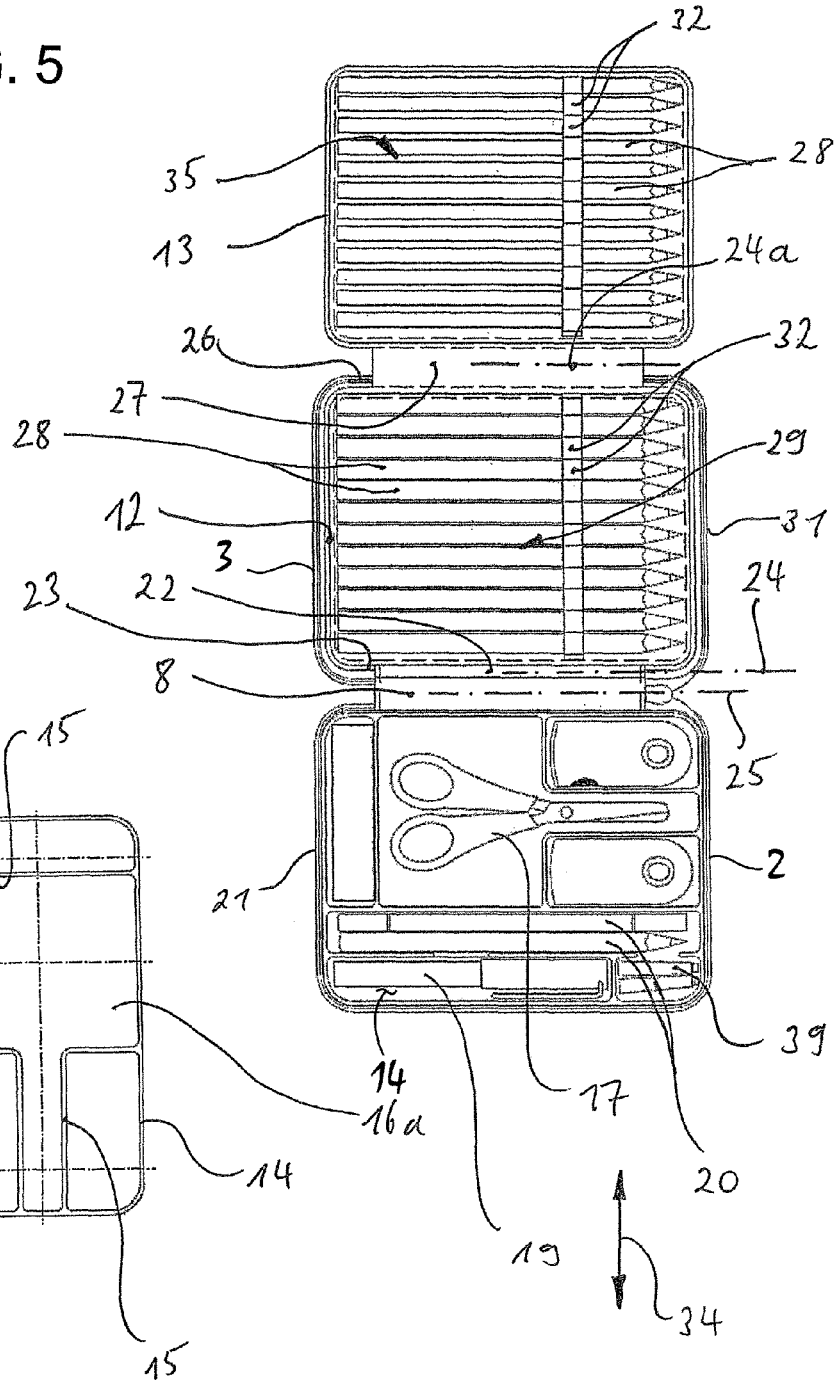
FIG. 5 is a top view of the case in a third use situation.
Figure 6:
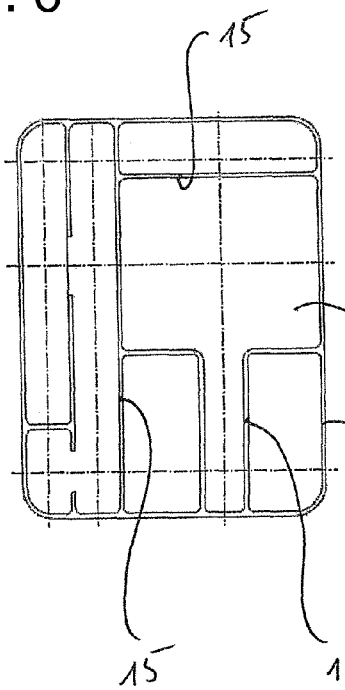
FIG. 6 is a top view of an insert which has compartments and can be positioned in the lower shell of the case.

The illustrations in FIGS. 3 to 5 show the case in the unfolded state. There, the upper shell 3 and lower shell 2 extend approximately in a flat plane in which they rest, for example, on a base (e.g., a table or desk). The lower shell 2 has different internals, namely a first plate 12, a second or additional plate 13, and an insert 14. The insert 14, which is illustrated separately in FIG. 6, is essentially an upwardly open box which is configured, for example, as an injection-molded part and in which compartments 16 of differing size and shape are formed by partitions 15. The compartment 16*a*, for example, serves to receive a pair of scissors 17 or to receive an object with a comparable shape. There are also, for example, compartments 16*b*, 16*c* which extend in the longitudinal direction 18 of the case 1 and serve to receive writing implements, for example a fountain pen 19 or pencils 20.

Figure 7:
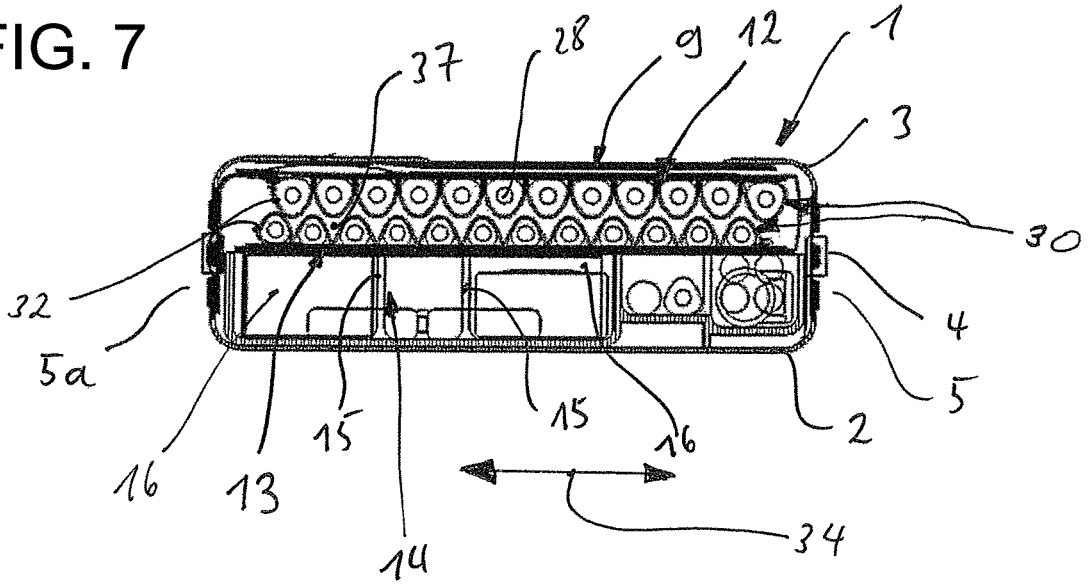
FIG. 7 is a cross section taken along the line VII-VII in FIG. 1 and viewed in the direction of the arrows.
Figure 8:
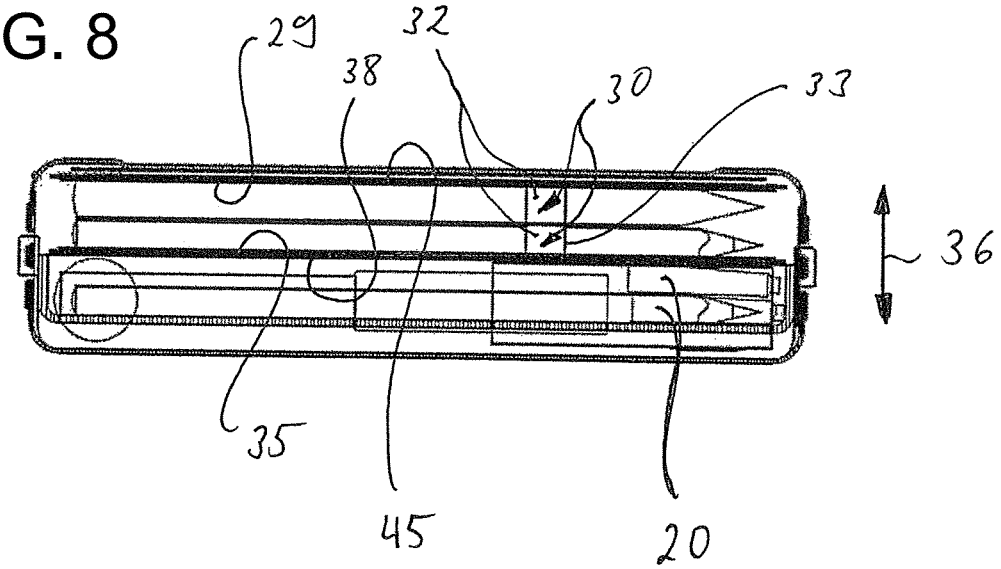
FIG. 8 is a cross section taken along the line VIII-VIII in FIG. 1 and viewed in the direction of the arrows.

The first plate 12—also referred to as the plate 12—has a contour shape corresponding to the lower shell 2 and is fixed to the lower shell 2 in the region of the rear side 5*a* via a flexible material strip 22, for example a textile strip. The flexible material strip 22 is connected to that longitudinal border 23 of the plate 12 which is located in the vicinity of the lower shell 2. Accordingly, the pivot axis 24 of the plate 12 runs substantially parallel to the pivot axis 25 of the upper shell 3 or lower shell 2. It would be conceivable for the plate 12 and the lower shell 2 to be connected to each other at their transverse borders 21, 31. The pivot axes 24, 25 would then run at right angles to each other. At any rate, the pivot axes 24, 25 each run parallel to the flat plane of the lower shell 2. The second plate 13—also referred to as the additional plate 13—is pivotally fixed to that longitudinal border 26 of the plate 12 which lies opposite the longitudinal border 23, via a flexible material strip 27 which can likewise be a textile strip, the pivot axis 24*a* of said additional plate running approximately parallel to the flat plane of the lower shell 2. The plate 12 and the additional plate 13 correspond in their size and are both manufactured from a flat material having a certain degree of rigidity, for example from a plastic blank or the like. The plate 12 and the additional plate 13 serve as supports for writing implements, in particular for pencils 28. For this purpose, there are holding elements 30 on the side pointing inward in the first pivoted position (FIGS. 3, 7, 8), i.e. the inner side 29 of the plate 12. The holding elements 30 are formed by loops 32 of an elastic tape 33 stitched onto the plate 12. The elastic tape 33 extends in the transverse direction 34 of the plate 12 and of the case 1. There are also corresponding holding elements 30 on the additional plate 13, to be precise on the side 35 thereof which points toward the inner side 29 of the plate 12 in the folded-in state (FIGS. 3, 7, 8). In the use state according to FIG. 5, said side, and the inner side 29 of the plate 12, lie next to each other, as seen in the transverse direction 34 of the case 1, such that all of the pencils held by the plates 12, 13 are visible and can easily be removed. Although the holding elements 30 of the plates 12, 13, which holding elements are designed as loops 32, are essentially of identical configuration, they are offset in relation to one another, for example by half of the diameter of the pencils 28 supported by them. This results in a space saving in the vertical direction 36 of the case 1 in which the pencils 28 of the one plate namely project partially into the intermediate spaces 37 present between the pencils 28 of the other plate (FIG. 7).

Taking the use situation according to FIG. 5 as the starting point, the additional plate 13 can first of all be folded by means of its side 35 onto the inner side 29 of the plate 12. Subsequently, the two plates are then pivoted into the lower shell 2, with the additional plate 13 resting, by means of its side 38 which faces away from the holding elements 30, on the insert 14 and closing the compartments 16. Since the additional plate 13, like the plate 12, is of a size or area which corresponds to the interior space of the lower shell 2, all of the compartments 16 are closed. Objects arranged therein then cannot drop out of the compartments 16 during the transportation of the case 1, and therefore, when they are used, they can always be found at the correct location or location assigned to them. In addition, the objects are separated from the pencils 28 by the additional plate 13. Therefore, objects present in the compartments 16 cannot damage the pencils 28. Similarly, impurities present in the compartments 16, for example sharpening residues from a pencil sharpener 39, cannot readily dirty the pencil surfaces.

An insert pocket 44, which is formed from two transparent films 42, 43, for accommodating a decorative material, for example a printed carbon blank (not shown), is fixed on the inner side 41 of the upper shell 3, which inner side faces the compartments 14 in the closed state of the case 1. Flat material bearing a painted or written inscription, for example name and address of the case owner, which can be seen via the viewing window 9 can be pushed into said insert pocket. A further transparent film 40, behind which, for example, a time table can be placed, is fitted on the side 38 of the additional plate 13. That side 45 of the plate 12 which points upward in the folded-in state bears an insert pocket 46, which is formed, for example, by means of an applied film, for example for a non-illustrated ruler.

The invention claimed is:

1. A case, comprising:

a body formed of a lower shell and an upper shell pivotally connected to said lower shell;

said lower shell having a plurality of compartments configured to receive objects;

a first plate pivotally mounted, with respect to said lower shell and said upper shell, to said body about a pivot axis extending substantially parallel to a flat plane of said lower shell, said first plate, in a first pivot position, resting on said lower shell and covering at least some of said plurality of compartments and, in a second pivot position, being swung out of said lower shell;

said first plate having an inner side facing said compartments in said first pivot position, and holding elements for writing implements disposed on said inner side of said first plate; and a second plate pivotally connected to a border region of said first plate about a pivot axis running approximately parallel to the flat plane of said lower shell and foldable onto said inner side of said first plate, said second plate carrying holding elements for writing implements on a side thereof facing said inner side of said first plate in the folded-in state, said holding elements being arranged in a row and are offset in a direction of the row relative to said holding elements of the other respective said plate, said second plate carrying holding elements for writing implements on a side thereof facing said inner side of said first plate in the folded-in state, said holding elements being arranged in a row and being offset in a direction of the row relative to said holding elements of the other respective said plate;

said second plate, in the first pivot position of said first plate and upon being folded onto said inner side of said first plate, being disposed between said first plate and said compartments and covering at least some of said compartments.

2. The case according to claim 1, wherein said pivot axes of said first and second plates run substantially parallel to one another, and said second plate is connected to a marginal border of said first plate opposite a marginal border thereof coupling said first plate to said body.

3. The case according to claim 1, which comprises a flexible material strip connecting said first plate to said body.

4. The case according to claim 3, wherein said material strip is attached to said lower shell.

5. The case according to claim 1, which comprises a flexible material strip connecting said first plate and said second plate.

6. The case according to claim 1, which comprises a zipper connecting said upper shell and said lower shell.

7. The case according to claim 1, which comprises an insert formed with compartments and disposed in said lower shell.

* * * * *